US006202707B1

(12) United States Patent
Woodall et al.

(10) Patent No.: US 6,202,707 B1
(45) Date of Patent: Mar. 20, 2001

(54) METHOD FOR DISPLACING PRESSURIZED LIQUEFIED GAS FROM CONTAINERS

(75) Inventors: Robert M. Woodall, The Woodlands; Moses Minta, Sugar Land, both of TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/464,296

(22) Filed: Dec. 15, 1999

Related U.S. Application Data

(60) Provisional application No. 60/112,974, filed on Dec. 18, 1998.

(51) Int. Cl.[7] ..... B63B 25/00

(52) U.S. Cl. ..... 141/1; 141/9; 141/4; 141/231; 141/5; 48/190; 62/50.1; 62/53.2

(58) Field of Search ..... 141/1, 2–5, 9, 141/18, 231; 48/190; 62/45.1, 50.1, 53.2

(56) References Cited

U.S. PATENT DOCUMENTS

| | | | |
|---|---|---|---|
| 334,481 | 1/1886 | Sone . | |
| 1,753,785 | 4/1930 | Heylandt . | |
| 2,435,332 | 2/1948 | Van Vleet et al. | 62/1 |
| 2,725,722 | 12/1955 | Ahlstrand et al. | 62/1 |
| 2,795,937 | 6/1957 | Sattler et al. | 62/1 |
| 2,940,268 | 6/1960 | Morrison | 62/7 |
| 2,972,873 | 2/1961 | Peet et al. | 62/51 |
| 2,975,608 | 3/1961 | Morrison | 62/53 |
| 2,983,409 | 5/1961 | Henry | 222/399 |
| 3,004,509 | 10/1961 | Leroux | 114/74 |
| 3,018,632 | 1/1962 | Keith | 62/9 |
| 3,145,680 | 8/1964 | Farkas et al. | 114/74 |
| 3,232,725 | 2/1966 | Secord et al. | 48/190 |
| 3,257,813 | 6/1966 | Hashemi-Tafreshi | 62/23 |
| 3,293,011 | 12/1966 | Lewis et al. | 48/190 |
| 3,298,805 | 1/1967 | Secord et al. | 48/190 |
| 3,324,670 | 6/1967 | Van Kleef | 62/55 |

(List continued on next page.)

FOREIGN PATENT DOCUMENTS

WO 97/16678 5/1997 (WO) .

OTHER PUBLICATIONS

Faridany, E. K., Ffooks R. C., and Meikle, R. B. A Pressure LNG System, European Offhshore Petroleum Conference & Exhibition (Oct. 21–24, 1980), vol. EUR 171, pp. 245–254.

Broeker, R. J. CNG and MLG–New Natural Gas Transportation Processes, *American Gas Journal* (Jul. 1969) pp. 138–140.

Fluggen, Prof. E. and Backhaus, Dr. I. H. *Pressurised LNG—and the Utilisation of Small Gas Fields*, Gastech78, LNG/LPG Conference (Nov. 7, 1978), Monte Carlo pp. 195–204.

Broeker, R. J. *A New Process for the Transportation of Natural Gas*, Proceedings of The First International Conference on LNG (1968), Chicago, Illinois, Session No. 5, Paper 30, pp. 1–11.

(List continued on next page.)

*Primary Examiner*—J. Casimer Jacyna
(74) *Attorney, Agent, or Firm*—Gary D. Lawson

(57) ABSTRACT

A method is disclosed for unloading a plurality of containers containing pressurized liquefied gas in which the liquefied gas has a temperature above −112° C. A pressurized displacement liquid is fed to a first of the plurality of containers to discharge the pressurized liquefied gas therefrom. The displacement liquid is then pumped from the first container to a second container of the plurality of containers to discharge liquefied gas therefrom. As the displacement liquid is removed from the first container, the space caused by the removal of the displacement liquid is filled with a vapor at a lower pressure than the pressure of displacement liquid. Fluid communication between the first second containers is then severed and the above steps are repeated for all containers in succession, except that for the last container in the series the displacement liquid is pumped therefrom to an auxiliary container for storage rather than to another container.

12 Claims, 1 Drawing Sheet

U.S. PATENT DOCUMENTS

| | | | |
|---|---|---|---|
| 3,365,898 | 1/1968 | Van Kleef | 62/55 |
| 3,422,779 | 1/1969 | Becker | 114/74 |
| 3,477,509 | 11/1969 | Arendt | 166/252 |
| 3,535,885 | 10/1970 | Frijlink | 62/9 |
| 3,690,115 | 9/1972 | Clayton | 62/49 |
| 3,830,180 | 8/1974 | Bolton | 114/74 |
| 3,831,811 | 8/1974 | Becker | 222/1 |
| 3,842,613 | 10/1974 | Becker | 62/50 |
| 3,877,240 | 4/1975 | Kniel et al. | 62/50 |
| 4,182,254 | 1/1980 | Secord | 114/74 |
| 4,292,909 | 10/1981 | Conway | 114/74 |
| 4,315,407 | 2/1982 | Creed et al. | 62/53 |
| 4,446,804 | 5/1984 | Kristiansen et al. | 114/74 |
| 5,199,266 | 4/1993 | Johansen | 62/8 |
| 5,211,021 | 5/1993 | Pierson | 62/50 |
| 5,243,821 | 9/1993 | Schuck et al. | 62/50 |
| 5,329,777 | 7/1994 | Weltmer, Jr. | 62/49.2 |
| 5,377,725 | 1/1995 | Hilliard, Jr. et al. | 141/4 |
| 5,398,629 | 3/1995 | Wasenius | 114/74 |
| 5,454,408 | 10/1995 | DiBella et al. | 141/197 |
| 5,476,126 | 12/1995 | Hilliard, Jr. et al. | 141/63 |
| 5,513,680 | 5/1996 | Hilliard, Jr. et al. | 141/4 |
| 5,699,839 | 12/1997 | Dehne | 141/248 |
| 5,950,453 | 9/1999 | Bowen et al. | 62/612 |

OTHER PUBLICATIONS

Ladkany, S. G. Composite Aluminum–Fiberglass Epoxy Pressure Vessels for Transportation of LNG at Intermediate Temperature, published in *Advances in Cryogenic Engineering, Materials*, vol. 28, (Proceedings of the 4th International Cryogenic Materials Conference), San Diego, CA, USA, Aug. 10–14, 1981, pp. 905–913.

Bennett, C. P. Marine Transportation of LNG at Intermediate Ttemperature, *CME* (Mar. 1979), pp. 63–64.

Faridany, E. K., Secord, H.C, O'Brien, J. V., Pritchard, J. F. and Banister, M. The Ocean Phoenix Pressure–LNG System, *Gastech 76* (1976), New York, pp. 267–280.-

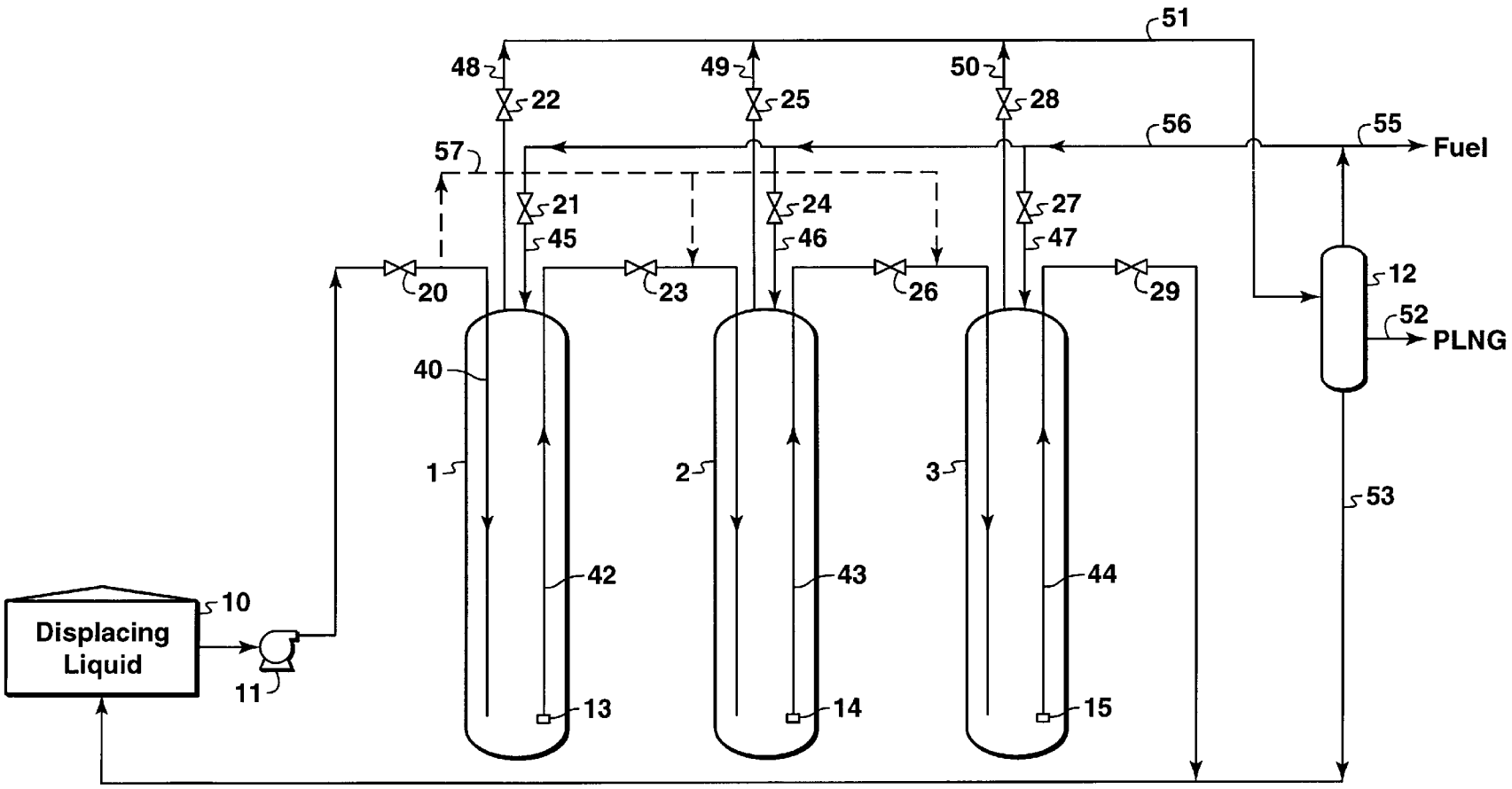
Fuel
PLNG
55
12
52
53
51
56
29
44
15
27
47
28
50
3
26
43
14
24
46
25
49
2
23
42
13
21
45
22
48
57
20
40
1
10
11
Displacing Liquid

METHOD FOR DISPLACING PRESSURIZED LIQUEFIED GAS FROM CONTAINERS

This application claims the benefit of U.S. Provisional Application No. 60/112,974, filed Dec. 18, 1998.

FIELD OF THE INVENTION

This invention relates to the handling of pressurized liquefied gas and, more particularly, to a method for unloading containers having pressurized liquefied gas contained therein.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

It has been recently proposed to transport natural gas at temperatures above −112° C. (−170° F.) and at pressures sufficient for the liquid to be at or below its bubble point. For most natural gas compositions, the pressure of the natural gas at temperatures above −112° C. will be between about 1,380 kPa (200 psia) and about 3,500 kPa (500 psia). This pressurized liquid natural gas is referred to as PLNG to distinguish it from LNG, which is transported at near atmospheric pressure and at a temperature of about −160° C.

If PLNG is unloaded from a container by pumping the PLNG out and allowing the container pressure to decrease, the decompression of the PLNG can lower the temperature in the container below the permitted design temperature for the container. If the pressure in the container is maintained as the PLNG is removed to avoid such temperature reduction, the vapor remaining in the container will contain a significant volume of the container's original cargo. Depending upon the pressure and temperature of storage and the composition of the PLNG, the vapors may constitute from about 10 to 20 percent of the mass of PLNG in the container before the liquid was removed. It is desirable to remove as much of this gas as is economically possible while keeping the container at approximately the same temperature as the PLNG before unloading.

SUMMARY

This invention relates to a method for unloading a plurality of containers containing liquefied gas and ullage gas in which the liquefied gas has a temperature above −112° C. and a pressure essentially at its bubble point. In the first step of the method, a pressurized displacement liquid is fed to a first of the plurality of containers to discharge the pressurized liquefied gas and ullage gas therefrom. The displacement liquid has a pressure greater than the pressure of the liquefied gas and is sufficient to displace the liquefied gas from the container. The displacement liquid is then pumped from the first container to a second container of the plurality of containers to discharge liquefied gas and ullage gas therefrom. As the displacement liquid is removed from the first container, the void space caused by the removal of the displacement liquid is filled with a vapor at a lower pressure than the pressure of displacement liquid in the second container. The pressure of the low pressure gas preferably ranges between about 50 and 200 psia and is preferably derived from the liquefied gas. The low pressure gas may for example be produced by revaporization of the liquefied gas or it may be boil-off from liquefied gas. Fluid communication between the first container and the second container is severed and these steps are repeated for all of the containers in succession except that for the last container in the series the displacement liquid is pumped therefrom to an auxiliary container for storage rather than another container.

In the practice of this invention, all the containers are emptied of the pressurized liquefied gas without significant decompression of the liquefied gas and the containers are filled with the lower pressure vapor. The lower pressure vapor in the containers will comprise substantially less mass than if the containers are emptied of liquefied gas and filled with high pressure gas. The gas in the containers is typically reliquefied when the containers are reloaded with liquefied gas. Reducing the amount of gas to be reliquefied at the liquefaction plant can significantly reduce the overall cost of transporting the liquefied gas.

DESCRIPTION OF THE DRAWING

The present invention and its advantages will be better understood by referring to the following detailed description and the attached drawing which is a schematic elevated view of containers and associated flow lines, valves and other equipment used in the practice of this invention. The drawing presents a preferred embodiment of practicing the process of this invention. The drawing is not intended to exclude from the scope of the invention other embodiments that are the result of normal and expected modifications of this specific embodiment.

DETAILED DESCRIPTION OF THE INVENTION

In the practice of this invention, a displacement liquid is pumped from a storage tank to the bottom of a first container or first group of containers to displace the liquefied gas from the first container/group while maintaining the pressure of the liquefied gas to approximately the same pressure of the liquefied gas before unloading. After the liquefied gas is removed from the first container/group, the displacement liquid is pumped out of the first container/group to a second container/group of containers. As the liquefied gas is being displaced by the displacement liquid, the operating pressure in the first container/group is maintained at approximately the same pressure as the pressure of the liquefied gas before unloading of liquefied gas. The liquefied gas is sent to a main shipping pump and vapor is used as fuel or is used as a source of low pressure gas in the unloading process.

Upon removal of the liquefied gas from the first container/group, the displacement liquid in the first container/group is pumped to the second container/group to displace liquefied gas therefrom. Simultaneous with pumping of the displacement liquid out of the first container, a low pressure gas is passed into the first container to fill the void space caused by liquid removal. The source of the gas is preferably boil-off gas from other containers of liquefied gas or revaporized liquefied gas produced in the unloading process or from revaporization facilities.

The invention will now be described with reference to the drawing which depicts three containers 1, 2, and 3 that may be located on shore or may be tanks on a ship. For the sake of simplifying the description of this invention, only three containers are shown in the drawing. It should be understood that this invention is not limited to a particular number of containers. A ship designed for transporting pressurized liquefied gas could have many more pressurized PLNG containers. The piping between the plurality of tanks can be so arranged that the containers can be unloaded in groups, and any group can be unloaded or discharged in any sequence. The unloading sequence should take into account the trim and stability of the container carrier which would be familiar to those skilled in the art of ship unloading.

Each container or group of containers is provided with pressure relief valves, pressure sensors, fluid level indicators, and pressure alarms systems and suitable insulation for cryogenic operation. These systems are omitted from the drawing since those skilled in the art are familiar with the construction and operation of such systems, which are not essential to understanding the practice of this invention.

In this description, it is assumed that the containers 1, 2, and 3 contain pressurized liquefied natural gas (PLNG). However, the invention is not limited to unloading PLNG, and other pressurized liquefied gases having low boiling point may be unloaded in the practice of this invention. The PLNG will be transported at a temperature above −112° C. and a pressure essentially at its bubble point. The term "bubble point" as used in this description is the temperature and pressure at which a liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point. At the bubble point, the liquefied gas is saturated liquid.

Referring again to the drawing, containers 1 and 2 are in fluid communication by line 42, and containers 2 and 3 are in fluid communication by line 43, and container 3 and fluid separator 12 are in fluid communication by line 44. Lines 42, 43, and 44 contain valves 23, 26, and 29, respectively, for severing or discontinuing such fluid communication. Fluid separator 12 also has liquid flow line 51 which is connected to containers 1, 2, and 3 by liquid flow lines 48, 49, and 50, respectively. Flow lines 48, 49, and 50 have valves 22, 25, and 28, respectively, for regulating flow through such flow lines. Overhead vapors from fluid separator 12 can be passed through line 56 to containers 1, 2, and 3 by flow lines 45, 46, and 47 respectively. Flow lines 45, 46, and 47 have conventional control valves 21, 24, and 27 to regulate flow of vapor through lines 45, 46, and 47 and to lower the pressure of gas from a relatively high pressure in line 56 to a desired lower pressure, for example 50 to 200 psia. Submersible pumps 13, 14, and 15 are located at or near the bottom of containers 1, 2, and 3 respectively to pump liquid through lines 42, 43, and 44.

Unloading of container 1 is accomplished by connecting line 40 to a suitable storage tank 10 containing displacement liquid. Valves 20 and 22 are opened and all of the other valves are closed. A suitable pump 11 delivers displacement liquid from the storage tank 10 through line 40 to the bottom of container 1. The displacement liquid displaces PLNG from container 1 through line 48 and line 51 to phase separator 12. The pressure of the displacement liquid introduced to container 1 must be greater than the pressure of the PLNG and adequate to discharge the PLNG from container 1. To avoid any substantial revaporization of PLNG the displacement liquid is preferably at a temperature near the temperature of the PLNG being displaced. Once the PLNG has been removed from container 1 by the displacement liquid, valves 20 and 22 are closed and valves 21, 23, and 25 are opened. The displacement liquid is pumped out of container 1 by pump 13 through line 42 to the bottom of container 2. PLNG in container 2 is displaced out of container 2 through lines 49 and 51 to phase separator 12. As the displacement liquid is removed from container 1, a low-pressure gas is introduced into container 1 through line 45 to replace the void space caused by removal of the liquid from container 1. Once container 2 is emptied of PLNG, valves 21, 23, and 25 are closed and valves 24, 26, and 28 are opened. Displacement liquid in container 2 is then pumped by pump 14 through line 43 to the bottom of container 3. Upon emptying of container 3 of PLNG by the displacement liquid, valves 26 and 28 are closed and valves 27 and 29 are opened and pump 15 pumps the displacement liquid to the storage tank 10. While the displacement fluid is being removed from container 3, low-pressure gas is introduced into container 3 through line 47. PLNG from separator 12 is passed by line 52 to a suitable facility for revaporization, for further processing, or for storage. Vapor from separator 12 may be used as a source of gas for filling the containers with low-pressure gas as discussed above or alternatively or in addition the vapor may be used as fuel. Any displacement liquid that may have carried over into lines 45, 46, and 47 during displacement of PLNG from containers 1, 2, and 3 is separated in separator 12 from the PLNG and returned to storage tank 10 by lines 53.

An optional flow line 57 may be used to supplement displacement liquid that may be needed to displace PLNG from one or more containers after the first container. For example, additional displacement liquid would be needed if displacement liquid is carried over into line 57 with the PLNG or if container 2 has a larger capacity than container 1.

The displacement liquid used in the practice of this invention can be any suitable liquid for displacement of pressurized liquefied gas from containers. The displacement liquid preferably has a freezing point below the temperature of the liquefied gas, has a density greater than the liquefied gas, has a low solubility with the liquefied gas at the operating conditions of the liquefied gas in the containers. Examples of suitable displacement liquids for displacement PLNG at temperatures below −112° C. and a pressure above 300 psia include ethyl alcohol, n-propyl alcohol, and tetra hydro furan, of which ethyl alcohol is preferred because of its lower cost. The choice of displacement liquid will depend upon a balance of the cost of the liquid versus solubility losses of the displacement liquid in the liquefied gas. Higher solubility may be acceptable if the displacement liquid is low cost.

Although not shown in the drawing, the low pressure gas may require warming by any suitable warming means prior to being introduced into the container if the pressure drop from the high pressure gas source to the containers causes the gas temperature to drop below the design temperature of the containers.

Unloading of all containers on a carrier ship or onshore facility is continued as described above until the last container is unloaded. In the practice of this unloading method, all of the containers are filled with low-pressure gas. If the low pressure gas is derived from the PLNG, such as boil-off from the PLNG, the mass of low pressure gas remaining in the containers after unloading of PLNG will represent about 1 to 3 percent of the mass of the original load of PLNG. The temperature and pressure of the gas will be within the minimum temperature and maximum pressure for the design of the containers.

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the PLNG. Also, the piping connections between the PLNG containers may be supplemented or reconfigured depending on the overall design requirements to achieve optimum and efficient heat exchange requirements. Additionally, certain processing of the PLNG removed from the ship may be accomplished by adding devices that are interchangeable with the phase separator 12 shown. As discussed above, the specifically disclosed embodiments and examples should not be used to limit or restrict the scope of the invention, which is to be determined by the claims below and their equivalents.

What is claimed is:

1. A method for displacement a plurality of containers containing liquefied gas rich in methane and ullage gas, said liquefied gas having a temperature above −112° C. (−170° F.) and a pressure at essentially its bubble point, comprising the steps of:

(a) feeding a pressurized displacement liquid to a first of said plurality of containers to discharge the pressurized liquefied gas and ullage gas therefrom, said displacement liquid having a pressure greater than the pressure of the liquefied gas;

(b) pumping the displacement liquid from the first container to a second container of the plurality of containers to discharge liquefied gas therefrom and filling the void space in the first container created by removal of the displacement liquid with a vapor at a lower pressure than the pressure of displacement liquid in the second container; and (c) severing fluid communication between the first container from the second container and repeating steps (a) and (b) for all of said containers in succession until all of the containers are emptied of the liquefied gas and filled with the lower pressure vapor, except that for the last container the displacement liquid is pumped therefrom to an auxiliary container.

2. The method of claim 1 wherein the temperature of the displacement liquid is above −112° C.

3. The method of claim 1 wherein the displacement liquid is ethanol.

4. The method of claim 1 wherein the displacement liquid is n-propyl alcohol.

5. The method of claim 1 wherein the displacement liquid is tetra hydra furan.

6. The method of claim 1 wherein the gas of step (b) is derived from the liquefied gas.

7. The method of claim 1 wherein the pressure of the vapor is less than 150 psia.

8. The method of claim 1 wherein the temperature of the displacement liquid is approximately the same temperature as the liquefied gas in the first container.

9. The method of claim 1 further comprising recycling the displacement pumped to the auxiliary tank in step (c) to provide at least part of the displacement liquid in step (a).

10. The method of claim 1 further comprising the steps of passing the discharged liquefied gas and the ullage gas of step (a) to a phase separator which produces a vapor phase and at least one liquid phase, withdrawing vapor from the separator, expanding the vapor to reduce its pressure, passing the expanded vapor to the first container as the low pressure vapor of step (b), and withdrawing from the separator for further handling liquid stream rich in the liquefied gas.

11. The method of claim 10 further comprising withdrawing from the separator a liquid stream rich in the displacement fluid.

12. The method of claim 11 further comprising the step of recycling the liquid rich in the displacement liquid withdrawn from the separator by providing at least a fraction of the displacement liquid in step (a) of claim 1.

* * * * *